US011075486B1

(12) United States Patent
Hack et al.

(10) Patent No.: US 11,075,486 B1
(45) Date of Patent: Jul. 27, 2021

(54) SIGNAL CONNECTOR SYSTEM

(71) Applicants: Harvey Paul Hack, Arnold, MD (US); James Richard Windgassen, Chester, MD (US); Keith J. Johanns, Dublin, OH (US); Carrie Elizabeth Wheeler, Crofton, MD (US); Timothy Gerard Patterson, Severn, MD (US); Robert Anthony Czyz, Schaumburg, IL (US); Anthony S. Czyz, Schaumburg, IL (US); Joseph Frank Turk, Denver, CO (US)

(72) Inventors: Harvey Paul Hack, Arnold, MD (US); James Richard Windgassen, Chester, MD (US); Keith J. Johanns, Dublin, OH (US); Carrie Elizabeth Wheeler, Crofton, MD (US); Timothy Gerard Patterson, Severn, MD (US); Robert Anthony Czyz, Schaumburg, IL (US); Anthony S. Czyz, Schaumburg, IL (US); Joseph Frank Turk, Denver, CO (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 0 days.

(21) Appl. No.: 16/806,575

(22) Filed: Mar. 2, 2020

(51) Int. Cl.
*H01R 13/64* (2006.01)
*H01R 13/6464* (2011.01)
(Continued)

(52) U.S. Cl.
CPC ..... *H01R 13/6464* (2013.01); *H01R 13/035* (2013.01); *H01R 13/28* (2013.01); *H01R 13/622* (2013.01); *H01R 43/26* (2013.01)

(58) Field of Classification Search
CPC ..... H01R 24/84; H01R 13/28; H01R 13/523
See application file for complete search history.

(56) References Cited

U.S. PATENT DOCUMENTS 110,422 A 12/1870 Beau
3,475,795 A 11/1969 Youngblood
(Continued)

FOREIGN PATENT DOCUMENTS

EP 2728983 A1 5/2014
JP S5830174 A 2/1983
(Continued)

OTHER PUBLICATIONS

Japanese Office Action for Application No. 2019-528086 dated Jul. 21, 2020.
(Continued)

*Primary Examiner* — Ross N Gushi
(74) *Attorney, Agent, or Firm* — Tarolli, Sundheim, Covell & Tummino LLP

(57) ABSTRACT

One example includes a signal connector system. The system includes a first connector comprising a first housing and first contacts formed from a self-passivating transition metal and configured to conduct an AC signal. The system also includes a second connector comprising a second housing and second contacts formed from the self-passivating transition metal and configured to electrically couple to a respective one of the first contacts to conduct the AC signal. The first and second housings can be coupled to enclose the signal connector and to create at least one fluid-filled channel between each of the electrically-connected first and second contact pairs in response to fastening the first and second connectors while submerged in a respective fluid to provide a resistive path in the at least one fluid-filled channel
(Continued)

for providing signal isolation between each of the electrically-connected first and second contact pairs.

20 Claims, 5 Drawing Sheets

(51) Int. Cl.

| | |
|---|---|
| ***H01R 13/03*** | (2006.01) |
| ***H01R 43/26*** | (2006.01) |
| ***H01R 13/622*** | (2006.01) |
| ***H01R 13/28*** | (2006.01) |

(56) References Cited

U.S. PATENT DOCUMENTS

| | | | | |
|---|---|---|---|---|
| 4,160,609 | A | 7/1979 | Jackson et al. | |
| 4,338,149 | A | 7/1982 | Quaschner | |
| 4,466,184 | A | 8/1984 | Cuneo et al. | |
| 4,687,695 | A | 8/1987 | Hamby | |
| 4,715,928 | A | 12/1987 | Hamby | |
| 4,737,118 | A * | 4/1988 | Lockard | H01R 12/68 439/295 |
| 5,130,691 | A | 7/1992 | Shintaku et al. | |
| 5,160,269 | A | 11/1992 | Fox, Jr. et al. | |
| 5,161,981 | A | 11/1992 | Deak et al. | |
| 5,419,038 | A | 5/1995 | Wang et al. | |
| 5,854,534 | A | 12/1998 | Beilin et al. | |
| 6,040,624 | A | 3/2000 | Chambers et al. | |
| 6,603,079 | B2 | 8/2003 | Biron | |
| 6,793,544 | B2 | 9/2004 | Brady et al. | |
| 6,924,551 | B2 | 8/2005 | Rumer et al. | |
| 7,012,812 | B2 | 3/2006 | Haba | |
| 7,251,712 | B2 | 7/2007 | Unno | |
| 7,407,408 | B1 | 8/2008 | Taylor | |
| 7,911,029 | B2 | 3/2011 | Cui | |
| 8,118,611 | B2 | 2/2012 | Jeon | |
| 8,135,281 | B2 | 3/2012 | Zhovnirovsky et al. | |
| 8,262,873 | B2 | 9/2012 | Wurm et al. | |
| 8,359,738 | B2 | 1/2013 | Takahashi et al. | |
| 9,197,006 | B2 | 11/2015 | Hack | |
| 9,485,860 | B2 | 11/2016 | Yosui | |
| 9,743,529 | B2 | 8/2017 | Lee et al. | |
| 9,847,632 | B2 | 12/2017 | Zivi et al. | |
| 9,893,460 | B2 | 2/2018 | Windgassen et al. | |
| 10,355,334 | B2 | 7/2019 | Bokenfohr et al. | |
| 10,681,812 | B2 | 6/2020 | Hartman | |
| 2003/0114026 | A1 | 6/2003 | Caldwell | |
| 2004/0038072 | A1 * | 2/2004 | Miura | H01L 23/49582 428/668 |
| 2004/0043675 | A1 | 3/2004 | Hiatt et al. | |
| 2004/0049914 | A1 | 3/2004 | Wang et al. | |
| 2009/0014205 | A1 | 1/2009 | Kobayashi et al. | |
| 2010/0063555 | A1 | 3/2010 | Janzig et al. | |
| 2010/0112833 | A1 | 5/2010 | Jeon | |
| 2012/0042481 | A1 | 2/2012 | Kempf | |
| 2013/0089290 | A1 | 4/2013 | Sloey et al. | |
| 2013/0196855 | A1 | 8/2013 | Poletto et al. | |
| 2014/0175671 | A1 | 6/2014 | Haba et al. | |
| 2014/0353014 | A1 | 12/2014 | Lai | |
| 2014/0364004 | A1 | 12/2014 | Oniki | |
| 2015/0011107 | A1 | 1/2015 | Hack | |
| 2015/0055914 | A1 | 2/2015 | Dell Anno et al. | |
| 2016/0014893 | A1 | 1/2016 | Yosui | |
| 2016/0100012 | A1 | 4/2016 | Haugseth et al. | |
| 2016/0233607 | A1 | 8/2016 | Windgassen et al. | |
| 2017/0149231 | A1 | 5/2017 | Zivi et al. | |
| 2018/0160304 | A1 | 6/2018 | Liu et al. | |
| 2018/0168042 | A1 | 6/2018 | Hartman | |
| 2019/0027800 | A1 | 1/2019 | El Bouayadi et al. | |
| 2019/0074568 | A1 | 3/2019 | Henry et al. | |
| 2019/0313530 | A1 | 10/2019 | Hartman | |
| 2020/0006655 | A1 | 1/2020 | Tang et al. | |
| 2020/0069855 | A1 | 3/2020 | Matthes et al. | |
| 2020/0083927 | A1 | 3/2020 | Henry et al. | |

FOREIGN PATENT DOCUMENTS

| | | | |
|---|---|---|---|
| JP | 2002064271 | A | 2/2002 |
| WO | 2004070734 | A1 | 8/2004 |
| WO | 2006/132108 | | 12/2006 |
| WO | 2006132108 | | 12/2006 |
| WO | 2018228897 | A1 | 12/2018 |
| WO | 2019096655 | | 5/2019 |

OTHER PUBLICATIONS

Non Final Office Action for U.S. Appl. No. 15/930,596 dated Feb. 2, 2021.

International Search Report for Application No. PCT/US2020/054257 dated Jan. 21, 2021.

Korean Office Action for Application No. 10-2019-7015946 dated Jan. 28, 2021.

Brown et al.: "Development, Testing and Track Record of Multi-Way Underwater Mateable Fiber-Optic Connectors for Deepwater Applications"; Copyright 2002, Offshore Technology Conference This paper was prepared for presentation at the 2002 Offshore Technology Conference held in Houston, Texas U.S.A., May 6-9, 2002.

Kaushal et al.: "Free Space Optical Communication: Challenges and Mitigation Techniques"; Department of Electrical, Electronics and Communication Engineering, ITM University, Gurgaon, Haryana, India-122017. Département de génie électrique, Ecole de technologie supérieure, Montréal (Qc), Canada; Jun. 16, 2015.

Mabrouk et al.: "Experimental Validation of Receiver Sensitivity for 100-Mbps Data Rates in Seawater by Using 2.4 GHz-Low-Power Electronics"; International Journal on Communications Antenna and Propagation (I.Re,C.A,P.), vol. 9, N. 1 ISSN 2039-5086 Feb. 2019.

Mendez et al.: "A Comparative Study of Underwater Wireless Optical Communication for Three Different Communication Links"; IOSR Journal of Electronics and Communication Engineering (IOSR-JECE) e-ISSN: 2278-2834,p-ISSN: 2278-8735.vol. 10, Issue 3, Ver. II (May-Jun. 2015), pp. 40-48 www.iosrjournals.org.

RMS Pump Tools: Subsea Wet-Mate & Dry-Mate Connector Systems; found on the internet on Apr. 14, 2020 at: http://www.rmspumptools.com/perch/resources/brochures/subsea-connectors-1.pdf.

"Wet-Mate-Connector-Study"; found on the internet Apr. 14, 2020 at https://ore.catapult.org.uk/app/uploads/2018/01/Wet-mate-connector-study.pdf.

International Search Report for Application No. PCT/US2021/015083 dated Apr. 13, 2021.

* cited by examiner

SIGNAL CONNECTOR SYSTEM

TECHNICAL FIELD

The present disclosure relates generally to communications, and specifically to a signal connector system.

BACKGROUND

Signal connectors that provide electrical connection between a pair of wires are necessary in nearly every piece of wired communications environment. There are numerous environmental challenges that can arise from ensuring connection of wires over long distances, such as to facilitate the use of signal connectors. One such environmental challenge includes the use of signal connectors in environments that can provide electrical conduction in ambient conditions. For example, electrical connections may be required in environments such as in fluids, such as water (e.g., seawater), that may create challenges in ensuring that separate signal conductors do not experience conduction between each other. Such conduction can lead to noise and/or cross-talk in the respective signals that are transmitted. Some connectors that can be implemented in such environments may be formed of non-traditional conductive materials. However, such materials, while potentially solving some of the environmental challenges, can introduce new challenges in such environments.

SUMMARY

One example includes a signal connector system. The system includes a first connector comprising a first housing, and includes first contacts formed from a self-passivating transition metal. Each of the first contacts can be configured to conduct an AC signal. The system also includes a second connector comprising a second housing and second contacts formed from the self-passivating transition metal. Each of the second contacts can be configured to electrically couple to a respective one of the first contacts to conduct the AC signal. The first and second housings can be coupled to enclose the signal connector and to create at least one fluid-filled channel between each of the electrically-connected first and second contact pairs in response to fastening the first and second connectors while submerged in a respective fluid to provide a resistive path in the at least one fluid-filled channel for providing signal isolation between each of the electrically-connected first and second contact pairs.

Another example includes a method for providing a plurality of AC signals along a respective plurality of conductors across a signal connector system. The method includes submerging a first connector and a second connector in a fluid. The first connector includes a first housing and a first plurality of contacts formed from a self-passivating transition metal. The second connector includes a second housing and a respective second plurality of contacts formed from the self-passivating transition metal, such that a dielectric film forms on a surface of the first and second contacts in response to submersion in the fluid. The method also includes attaching the first and second connectors to provide electrical connection between the each of the first contacts and a respective one of the second contacts to conduct a respective one of the AC signals between the respective electrically-connected first and second contact pair, and to form at least one fluid-filled channel between each electrically-connected first and second contact pair. Each of the fluid-filled channel(s) forms a resistive path between electrically-connected first and second contact pairs. The method further includes fastening the first and second connectors via a first fastener associated with the first connector and a second fastener associated with the second connection portion to form the signal connector system.

Another example includes a signal connector system. The system includes a first connector. The first connector includes a first plurality of contacts formed from a self-passivating transition metal. Each of the first contacts being configured to conduct an AC signal. The first connector also includes a first plurality of pliable insulator supports that are coupled to a respective one of the first contacts, and a first housing configured to substantially enclose the first pluralities of contacts and pliable insulator supports and comprising a first fastener. The system also includes a second connector. The second connector also includes a second plurality of contacts formed from the self-passivating transition metal, a second plurality of pliable insulator supports that are coupled to a respective one of the second contacts, and a second housing configured to substantially enclose the second pluralities of contacts and pliable insulator supports and comprising a second fastener. The first and second housings can be configured to be coupled via the respective first and second fasteners to substantially enclose the signal connector and to provide electrical connection between each of the first contacts and a respective one of the second contacts at a predetermined pressure to conduct the respective AC signal between each of the first contacts and the respective one of the second contacts.

DETAILED DESCRIPTION

Figure 1:
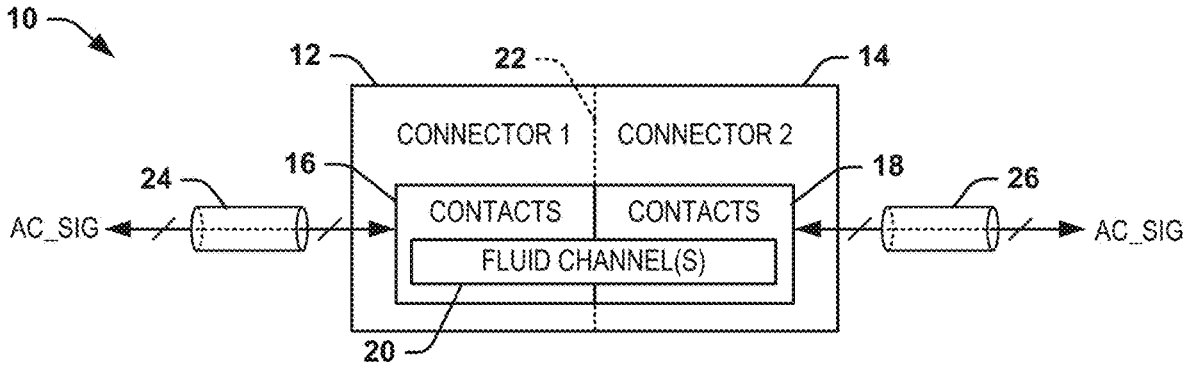
FIG. 1 illustrates an example diagram of a signal connector system.

The present disclosure relates generally to communications, and specifically to a signal connector system. The signal connector system can be implemented in any of a variety of applications to provide a connection point for conductors (e.g., wires) that can each propagate a alternating current (AC) communication signal (hereinafter, "AC signal(s)"). As described herein, the term AC signal can refer to any variable amplitude signal, and is not limited to periodic or high-speed communications signals (e.g., radio frequency (RF) signals). The signal connector system includes a first connector and a second connector. As an example, the signal connector system can be implemented in an environment in which traditional connectors cannot be employed, such as in fluids. For example, the signal connector system can be implemented in an environment in which the first and second connectors can be connected with each other to form the signal connector system in such a non-traditional connection environment, such as submerged in a fluid (e.g., water). As an example, the first and second connectors can each be separately submerged in the fluid before being coupled together. As described herein, the signal connector system can be fabricated and arranged to facilitate propagation of separate AC signals on separate respective conductors in the fluid without experiencing noise and/or cross-talk between the separate respective conductors.

The first connector includes a first housing, and also includes a first plurality of contacts formed from a self-passivating transition metal. Each of the first contacts can be configured to conduct one of the AC signals. Similarly, the second connector includes a second housing and a second plurality of contacts formed from the self-passivating transition metal. For example, the self-passivating transition metal can be any of niobium, tantalum, titanium, zirconium, molybdenum, ruthenium, rhodium, palladium, hafnium, tungsten, rhenium, osmium, and iridium. Each of the second contacts can be configured to electrically couple to a respective one of the first contacts to conduct the AC signal. When submerged in the fluid (e.g., water), the contacts develop a dielectric film that acts as a high-capacitance capacitor between the self-passivating transition metal and the fluid.

For direct current (DC) signals, the high DC resistance of the dielectric film thus provides insulation between the separate contacts in the fluid. However, for AC signals, the capacitance of the dielectric film presents a low AC reactance and acts as a high-pass filter, which can provide some conduction between the separate contacts resulting in cross-talk and/or noise in the respective separate AC signals. Therefore, when the first and second housings are coupled to substantially enclose the signal connector, the first and second housings can provide at least one channel for accommodating the fluid between each of the electrically-coupled first and second contact pairs to provide a resistive path that appears in series with the capacitances between the electrically-coupled first and second contact pairs. The resistive path can therefore provide signal isolation between the AC signals to substantially mitigate the conduction of the AC signals between the separate electrically-coupled first and second contact pairs to substantially mitigate the cross-talk and/or noise associated with the AC signals.

FIG. 1 illustrates an example of a signal connector system 10. The signal connector system 10 can be implemented in any of a variety of applications to provide a connection point for conductors (e.g., wires) that can each propagate an alternating current (AC) signal. As described herein, the signal connector system 10 can be implemented in an environment that may require submersion of the signal connector system 10, such as in water (e.g., seawater).

The signal connector system 10 includes a first connector ("CONNECTOR 1") 12 and a second connector ("CONNECTOR 2") 14. The first connector 12 includes a plurality of contacts ("CONTACTS") 16 formed from a self-passivating transition metal and the second connector 14 includes a plurality of contacts ("CONTACTS") 18 formed from the self-passivating transition metal. As an example, the self-passivating transition metal can be niobium, or any other of a variety of transition metals (e.g., tantalum, titanium, zirconium, molybdenum, ruthenium, rhodium, palladium, hafnium, tungsten, rhenium, osmium, and iridium). Additionally, upon fastening of the first and second connectors 12 and 14, at least one fluid channel ("FLUID CHANNEL(S)") 20 can be formed in the signal connector system 10, such as between electrically-connected sets of the contacts 16 and 18. In the example of FIG. 1, the connectors 12 and 14 are demonstrated as fastened together, such as by fasteners (not shown), to form the signal connector system 10, as demonstrated by a dotted line 22. Each of the sets of contacts 16 and 18 are demonstrated as being coupled, respectively, to a respective set of conductors (e.g., wires) 24 and 26 that are configured to propagate AC signals, demonstrated in the example of FIG. 1 as a signal AC_SIG. Therefore, when the connectors 12 and 14 are fastened together, each of the contacts 16 is coupled to a respective one of the contacts 18 to provide electrical connection between the contacts 16 and 18. As a result, the AC signals AC_SIG can propagate between the sets of conductors 24 and 26 via the respective sets of electrically-connected contact pairs 16 and 18.

When submerged in the fluid (e.g., water), the self-passivating transition metal contacts 16 and 18 develop a dielectric film that acts as a high-capacitance capacitor between the respective contacts 16 and 18 and the associated fluid. For direct current (DC) signals, the high DC resistance of the dielectric film thus provides insulation between the separate contacts 16 and 18 in the fluid. However, for AC signals, the capacitance of the dielectric film presents a low AC reactance and acts as a high-pass filter, which can provide some conduction between the separate contacts resulting in cross-talk and/or noise in the respective separate AC signals. Therefore, in the example of FIG. 1, when the first and second connectors 12 and 14 are coupled to substantially enclose the signal connector system 10 (e.g., via respective housings, as described in greater detail herein), the fastening of the first and second connectors 12 and 14 can form the channel(s) 20 for accommodating the fluid between each of the electrically-coupled first and second contact pairs 16 and 18 to provide a resistive path between the electrically-coupled first and second contact pairs 16 and 18. For example, the resistive path can have a resistance magnitude that is sufficient to provide signal isolation between the AC signals AC_SIG in spite of the capacitance between them, and therefore can mitigate cross-talk and/or noise between the separate AC signals AC_SIG. As an example, the resistance magnitude can be greater than or equal to approximately 100Ω. As described herein, the channel(s) 20 can be dimensioned to provide a desired resistance magnitude based on the properties of the fluid that fills the channel(s) 20.

As an example, the contacts 16 and 18 can each be fabricated to include a tapered contact surface that is arranged to provide the electrical connection with a complementary tapered contact surface of a respective other one of the contacts 16 and 18. Additionally, the first and second connectors 12 and 14 can also include pliable insulator supports that can be coupled to each of the respective contacts 16 and 18. The pliable insulator supports can provide a predetermined contact pressure between the first and second contacts 16 and 18, such as to provide sufficient pressure to establish electrical connection between the first and second contacts 16 and 18. For example, the contact pressure can be sufficient to scrape and remove the insulating film that develops on the self-passivating transition metal when it is submerged in the fluid to provide direct metal-to-metal contact between the respective contacts 16 and 18. The pliable insulator supports can also limit the amount of contact pressure, such as to substantially mitigate galling of the contact surfaces of the contacts 16 and 18. Furthermore, as described in greater detail herein, the pliable insulator supports can further be configured to at least in part establish the channel(s) 20 between respective electrically-connected pairs of the contacts 16 and 18.

Figure 2:
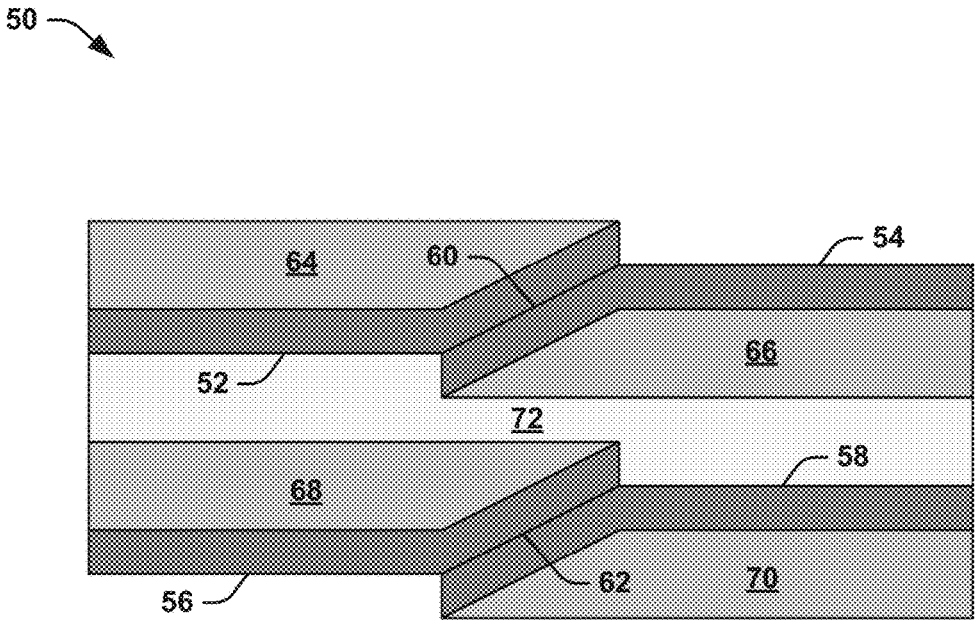
FIG. 2 illustrates another example cross-sectional diagram of a signal connector system.

FIG. 2 illustrates another example cross-sectional diagram of a signal connector system 50. The signal connector system 50 can correspond to a diagrammatic portion of the signal connector system 10 in the example of FIG. 1. Therefore, reference is to be made to the example of FIG. 1 in the following description of the example of FIG. 2.

The signal connector system 50 includes a first contact 52 and a second contact 54. Similarly, the signal connector system 50 includes a third contact 56 and a fourth contact 58. As an example, the contacts 52, 54, 56, and 58 can be formed from a self-passivating transition metal, as described previously. The first and second contacts 52 and 54 are demonstrated as electrically connected at respective tapered contact surfaces, demonstrated at 60, and the third and fourth contacts 56 and 58 are demonstrated as electrically connected at respective tapered contact surfaces, demonstrated at 62. As an example, the first and third contacts 52 and 56 can be fabricated as a part of the first connector 12 and the second and fourth contacts 54 and 58 can be fabricated as part of the second connection portion 14.

Additionally, the signal connector system 50 includes a first pliable insulator support 64 that is coupled to the first contact 52, a second pliable insulator support 66 that is coupled to the second contact 54, a third pliable insulator support 68 that is coupled to the third contact 56, and a fourth pliable insulator support 70 that is coupled to the fourth contact 58. Each of the pliable insulator supports 64, 66, 68, and 70 are likewise tapered to be coupled along a longitudinal surface of the respective contacts 52, 54, 56, and 58 that is opposite the tapered contact surfaces of the respective contacts 52, 54, 56, and 58. As described previously, the pliable insulator supports 64 and 66 can provide a predetermined contact pressure between the first and second contacts 52 and 54, such as to provide sufficient pressure to establish electrical connection between the first and second contacts 52 and 54. Similarly, the pliable insulator supports 68 and 70 can provide a predetermined contact pressure between the third and fourth contacts 56 and 58, such as to provide sufficient pressure to establish electrical connection between the third and fourth contacts 56 and 58. For example, the contact pressure can be sufficient to scrape and remove the insulating film that develops on the self-passivating transition metal material when it is submerged in the fluid to provide direct metal-to-metal contact between the respective contacts 52 and 54 and the contacts 56 and 58. As also described previously, the pliable insulator supports 64, 66, 68, and 70 can also limit the amount of contact pressure, such as to substantially mitigate galling of the contact surfaces of the respective contacts 52, 54, 56, and 58.

Furthermore, as described previously, the pliable insulator supports 64, 66, 68, and 70 can further be configured to form the channel(s) between respective electrically-connected pairs of the contacts. In the example of FIG. 2, the pliable insulator supports 64 and 68 can extend such that there is a longitudinal overlap with respect to the extension of the pliable insulator supports 66 and 70. The longitudinal overlap of the extension of the pliable insulator supports 64, 66, 68, and 70 can thus form the respective fluid-filled channels between the contact surfaces of the respective pairs of the contacts 52 and 54 and the contacts 56 and 58. In the example of FIG. 2, the pliable insulator support 66 and the pliable insulator support 68 are demonstrated as forming a fluid-filled channel, demonstrated generally at 72, that occupies the longitudinal overlap of the extension of the respective pliable insulator supports 66 and 68.

Figure 3:
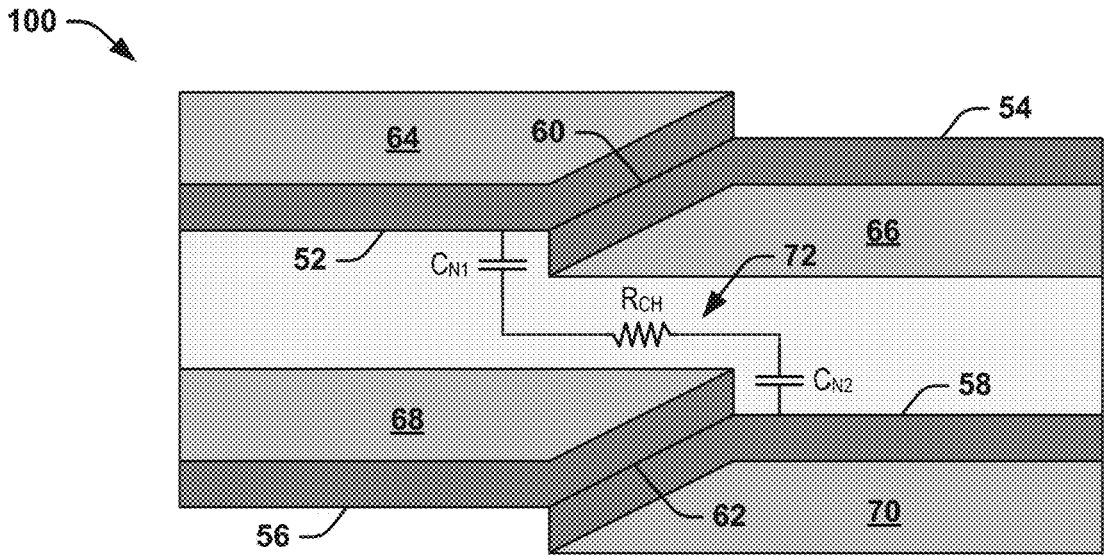
FIG. 3 illustrates another example cross-sectional diagram of a signal connector system.

The fluid-filled channel 72 can thus create a resistive path between the electrically-connected contact pair 52 and 54 and the electrically-connected contact pair 56 and 58, as demonstrated in the example of FIG. 3. FIG. 3 illustrates another example cross-sectional diagram 100 of the signal connector system 50. Therefore, like reference numbers are used in the example of FIG. 3 as used in the example of FIG. 2.

As described previously, when submerged in the fluid (e.g., water), the self-passivating transition metal contacts 52, 54, 56, and 58 develop a dielectric film that acts as a high-capacitance capacitor between the respective contacts 52, 54, 56, and 58 and the associated fluid. In the example of FIG. 3, the high-capacitance capacitors created by the dielectric film are demonstrated by a capacitor $C_{N1}$ corresponding to the dielectric film associated with the contacts 52 and 54 and a capacitor $C_{N2}$ corresponding to the dielectric film associated with the contacts 56 and 58. Because the capacitors $C_{N1}$ and $C_{N2}$ behave as high-pass filters for the AC signals AC_SIG, the AC signals AC_SIG would be free to conduct between the respective pairs of the contacts 52 and 54 and the contacts 56 and 58. However, by forming the fluid-filled channel 72 between the respective pairs of the contacts 52 and 54 and the contacts 56 and 58, the fluid-filled channel 72 provides a resistive path between the capacitors $C_{N1}$ and $C_{N2}$, with the resistive path being demonstrated in the example of FIG. 3 as a resistor $R_{CH}$.

For example, the resistance $R_{CH}$ of the resistive path created by the fluid-filled channel 72 can have a resistance magnitude that is sufficient for providing signal isolation between the AC signals AC_SIG, and therefore for mitigating cross-talk and/or noise between the separate AC signals AC_SIG. As an example, the resistance magnitude of the resistance $R_{CH}$ can be greater than or equal to approximately 100Ω, and can be at least one order of magnitude greater based on the design dimensions of the fluid-filled channel 72 and the fluid disposed therein. For example, the design dimensions of the fluid-filled channel 72 and the resistivity p of the associated fluid can be determinative of the resistance of the resistive path. Therefore, the dimensions of the fluid-filled channel 72 (e.g., length and width) can be designed to provide a predetermined resistance of the resistive path created by the fluid-filled channel 72. Accordingly, based on the inclusion of the fluid-filled channel 72 to provide a resistive path between the respective pairs of the contacts 52 and 54 and the contacts 56 and 58, the signal connector system 10 can be implemented for propagating AC signals, such as radio frequency (RF) communication signals in environments that cannot typically support AC signal propagation, such as in submerged aquatic or other environments.

While the fluid-filled channel 72 is demonstrated in the examples of FIGS. 2 and 3 as occupying the longitudinal overlap of the extension of the respective pliable insulator supports 66 and 68, it is to be understood that the fluid-filled channel 72 can be one of a plurality of fluid-filled channels to provide a resistive path between the respective pairs of the contacts 52 and 54 and the contacts 56 and 58. For example, as described in greater detail herein, the connectors 12 and 14 can also create an inner-ring and/or an outer-ring fluid-filled channel that is substantially circumscribed by or substantially surrounds, respectively, the plurality of contacts 16 and 18 in response to the connectors 12 and 14 being fastened together.

Figure 4:
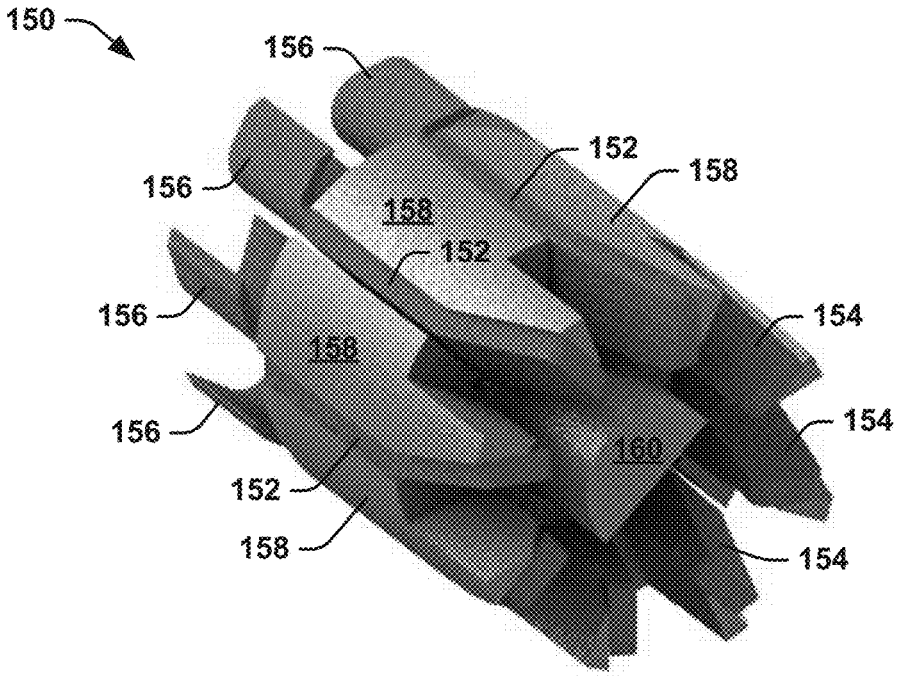
FIG. 4 illustrates an example of a connector.

FIG. 4 illustrates an example of a connector 150. The connector 150 can correspond to one of the connectors 12 and 14 in the example of FIG. 1. Therefore, reference is to be made to the examples of FIGS. 1-3 in the following description of the example of FIG. 4.

The connector 150 is demonstrated as an interior rendering of a connector. Therefore, the example of FIG. 4 does not demonstrate an associated housing that substantially encloses the connector 150. The connector 150 includes a plurality of contacts 152 formed from a self-passivating transition metal that extend through the connector 150. The contacts 152 include a tapered contact surface 154, similar to as demonstrated in the examples of FIGS. 2 and 3, at one end and include a set of conductor connection portions 156 at an opposite end. The conductor connection portions 156 can be coupled to one of the sets of conductors 24 and 26 in the example of FIG. 1. The connector 150 also includes a plurality of pliable insulator supports 158 that are each coupled to a respective one of the contacts 152. Thus, the pliable insulator supports 158 likewise extend longitudinally through the connector 150, with the contacts 152 each being coupled along a longitudinal surface of a respective one of the pliable insulator supports 158. As an example, each of the pliable insulator supports 158 can be coupled to the housing (not shown) at at least one portion of the peripheral surface of the respective one of the pliable insulator supports 158.

In the example of FIG. 4, the contacts 152 and the respective pliable insulator supports 158 are arranged in a polar array about a central axis of the connector 150. In the example of FIG. 4, the contacts 152 and respective pliable insulator supports 158 are demonstrated as having a quantity of eight, such that the connector 150, and thus the resulting signal connector system 10 can support propagation of eight different AC signals AC_SIG. The connector 150 also includes a central hub 160 that can provide connection keying for the connector 150 to provide a single solution for electrical connectivity of the contacts 152 with the contacts of a mating connector. As an example, the mating connector can be arranged substantially the same as the connector 150.

Figure 5:
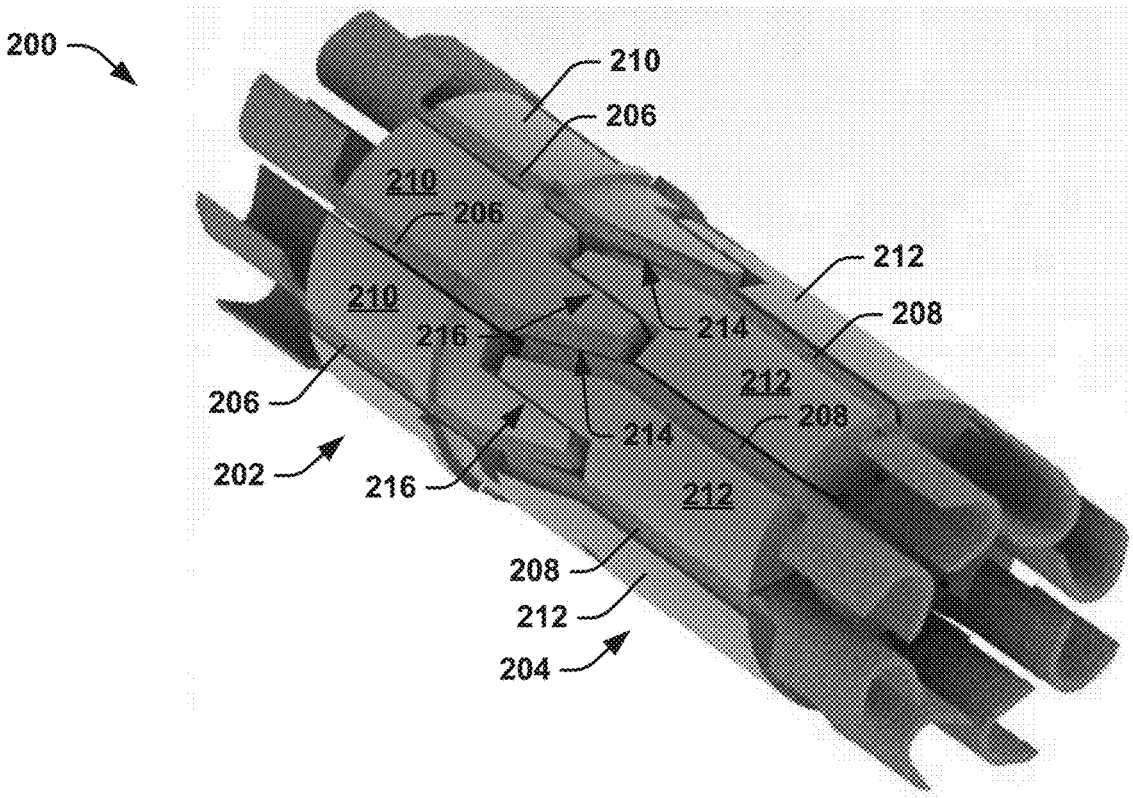
FIG. 5 illustrates an example of a signal connector system.

FIG. 5 illustrates an example of a signal connector system 200. The signal connector system 200 can correspond to the signal connector system 10 in the example of FIG. 1, and can be arranged based on the fastening of two substantially identical connectors 150 in the example of FIG. 4. Therefore, reference is to be made to the examples of FIGS. 1-4 in the following description of the example of FIG. 5.

The signal connector system 200 includes a first connector 202 and a second connector 204 having been coupled together, such as based on the fastening of respective housing portions. The signal connector system 200 is demonstrated as an interior rendering of a signal connector system. Therefore, the example of FIG. 5 does not demonstrate associated housings that substantially encloses each of the connectors 202 and 204, and thus the signal connector system 200. In the example of FIG. 5, the first connector 202 includes contacts 206 formed from a self-passivating transition metal and the second connector 204 includes contacts 208 formed from the self-passivating transition metal. The first connector 202 also includes pliable insulator supports 210 and the second connector 204 also includes pliable insulator supports 212. As described previously, the pliable insulator supports 210 and 212 can provide a predetermined contact pressure between the contacts 206 and 208, such as to provide sufficient pressure to establish electrical connection between the contacts 206 and 208 without galling.

The contacts 206 of the first connector 202 are thus demonstrated as being electrically-connected to the contacts 208 of the second connector 204 at respective tapered contact surfaces, demonstrated generally at 214. Similar to as described previously, the pliable insulator supports 210 and 212 can cooperate to form channels, demonstrated in the example of FIG. 5 at 216, between the respective electrically-connected pairs of the contacts 206 and 208. Similar to as demonstrated in the examples of FIGS. 2 and 3, the pliable insulator supports 210 and 212 can extend such that there is a longitudinal overlap with respect to the extension of the pliable insulator supports 210 and 212 to form the respective channels. Therefore, each of the connectors 202 and 204 can be submerged in a fluid (e.g., water) prior to fastening the connectors 202 and 204 (e.g., via the associated housings) to fill the channels 216 with the fluid. Accordingly, the channels 216 can provide resistive paths between the electrically-connector pairs of the contacts 206 and 208. Additionally, the fastening of the first and second connectors 202 and 204 can result in additional channels, such as in the ring between the central hubs 160 and the respective contacts 206 and 208 and respective pliable insulator supports 210 and 212 of each of the connectors 202 and 204, or between the respective contacts 206 and 208 and respective pliable insulator supports 210 and 212 and the respective housings of each of the connectors 202 and 204.

As described previously, the coupling of the contacts 206 and 208 to provide the electrical connection between the contacts 206 and 208 can involve a scraping of the dielectric film that forms on the self-passivating transition metal contacts 206 and 208 when submerged in the fluid. To better achieve such scraping of the dielectric film, such as in an environment or fluid that can facilitate a sedimentary or gritty build-up on the contacts 206 and 208, one of the sets of contacts 206 and 208 can include a projection that extends from the tapered contact surface.

Figure 6:
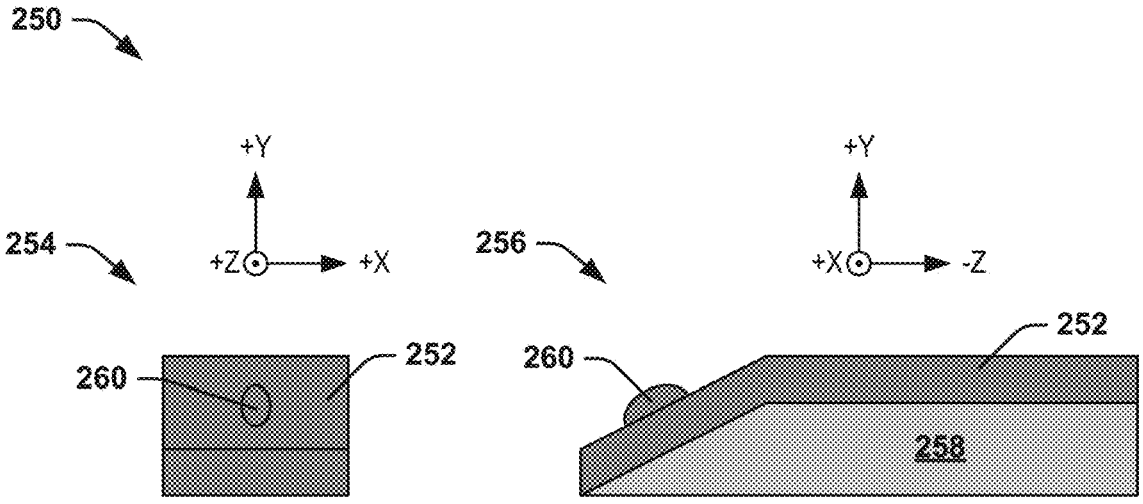
FIG. 6 illustrates an example of a contact.

FIG. 6 illustrates an example diagram 250 of a contact 252. As an example, the contact 252 is formed from a self-passivating transition metal. The contact 252 is demonstrated in a first view 254 and a second view 256 orthogonal with the first view 252, as demonstrated in the Cartesian coordinate system. The contact 252 is demonstrated as being coupled to a pliable insulator support 258, similar to as described previously. In the example of FIG. 6, the contact 252 includes a projection 260 that extends from the tapered contact surface of the contact 252. The projection 260 is demonstrated as occupying less than the area of the tapered contact surface, such as to provide a significantly smaller contact area with a mating tapered contact portion of an associated mating connector. Therefore, when the connector (e.g., one of the connectors 252 and 254) is fastened to the mating connector, the projection 260 can scrape along the tapered contact surface of the mating contact of the associated mating connector (e.g., that has a flat tapered contact surface) to provide the electrical connection. As a result, the projection 260 can more effectively scrape away the dielectric film on the contact 252 and the mating contact, as well as to ensure electrical connection despite any sediment and gritty residue that might be interposed between the tapered contact surfaces of the contact 252 and the mating contact.

Figure 7:
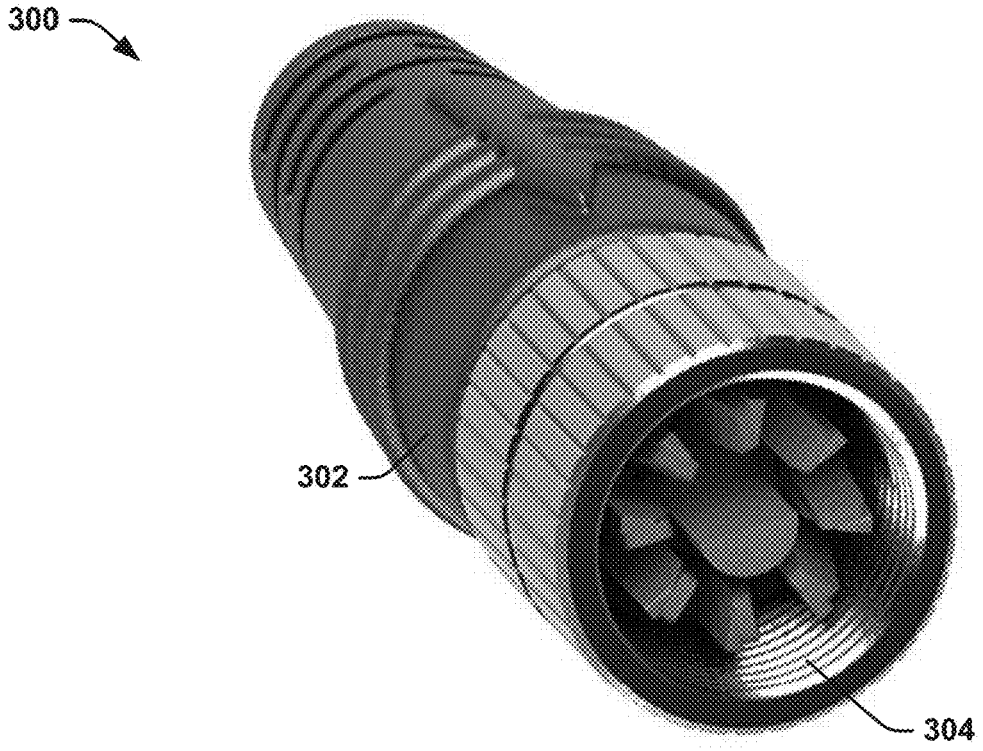
FIG. 7 illustrates another example of a connector.
Figure 8:
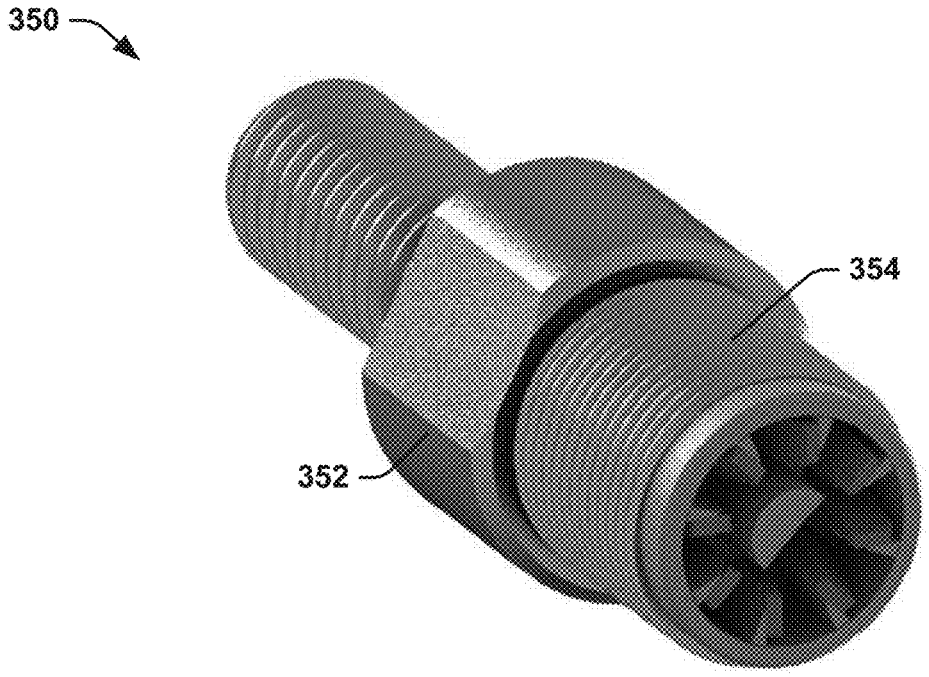
FIG. 8 illustrates another example of a connector.

FIGS. 7 and 8 each illustrate examples of connectors. The example of FIG. 7 illustrates an example of a connector 300 and the example of FIG. 8 illustrates an example of a connector 350. The connectors 300 and 350 can each correspond to the respective connectors 12 and 14 in the example of FIG. 1 or the respective connectors 202 and 204 in the example of FIG. 5. Therefore, reference is to be made to the examples of FIGS. 1-6 in the following description of the examples of FIGS. 7 and 8.

The connectors 300 and 350 are each demonstrated as renderings of connectors. As an example, the connectors 300 and 350 can each correspond to more complete renderings of the connector 150 in the example of FIG. 4. The connector 300 is demonstrated as including an exterior housing 302 that substantially surrounds the contacts and pliable insulator supports therein. Similarly, the connector 350 is demonstrated as including an exterior housing 352 that substantially surrounds the contacts and pliable insulator supports therein. In the example of FIGS. 7 and 8, the housings 302 and 352 each include a fastener to facilitate fastening the connectors 300 and 350 together as a mated pair to form a signal connector system (e.g., the signal connector system 200 in the example of FIG. 5).

In the example of FIG. 7, the fastener is demonstrated as a female (e.g., inner) thread pattern 304, and in the example of FIG. 8, the fastener is demonstrated as a male (e.g., outer) thread pattern 354. Therefore, the connectors 300 and 350 can be screwed together via the thread patterns 304 and 354 to provide electrical connection of the respective contacts therein and to form the channels (e.g., between opposing surfaces of respective pliable insulator supports therein). Based on the thread patterns 304 and 354 and based on the polar array arrangement of the contacts disposed therein, respectively, the fastening of the connectors 300 and 350 can provide for a substantially uniform contact pressure of the electrical connection of the contacts of the connector 300 to the contacts of the connector 350.

While the examples of FIGS. 7 and 8 demonstrate the fasteners as the thread patterns 350 and 354, it is to be understood that the signal connector system 10 described herein is not limited to threaded connections for fastening the respective connectors 12 and 14. For example, the connectors can include a variety of fastener types (e.g., snap-fit) that are designed to provide a joined state of the connectors 12 and 14. Additionally, the connectors 12 and 14 can include any of a variety of geometries of contacts and/or pliable insulator supports. Accordingly, the signal connector system 10 is not limited to as described herein.

Figure 9:
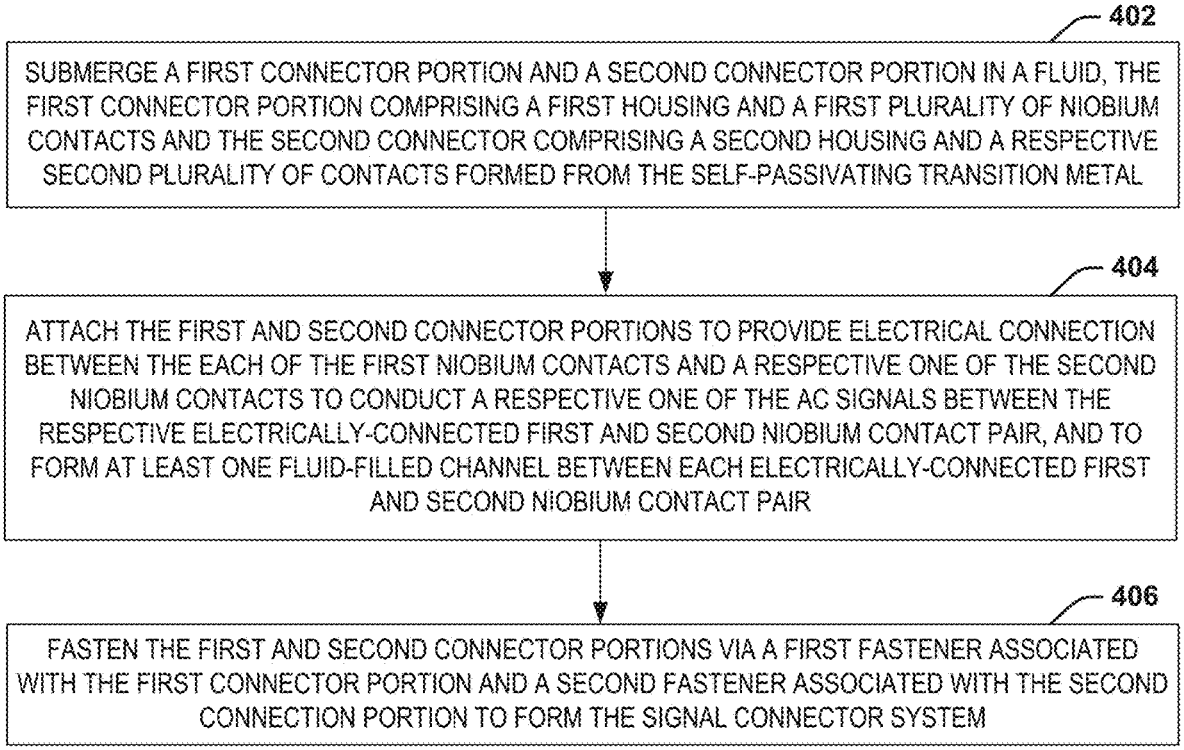
FIG. 9 illustrates an example of a method for providing a plurality of AC signals along a respective plurality of conductors across a signal connector system.

In view of the foregoing structural and functional features described above, an example method will be better appreciated with reference to FIG. 9. While, for purposes of simplicity of explanation, the method is shown and described as executing serially, it is to be understood and appreciated that the method is not limited by the illustrated order, as parts of the method could occur in different orders and/or concurrently from that shown and described herein.

FIG. 9 illustrates an example of a method 400 method for providing a plurality of AC signals (e.g., the AC signals AC_SIG) along a respective plurality of conductors across a signal connector system (e.g., the signal connector system 10). At 402, a first connector (e.g., the first connector 12) and a second connector (e.g., the second connector 14) are each submerged in a fluid (e.g., water). The first connector can include a first housing (e.g., the housing 302) and a first plurality of contacts (e.g., the first contacts 16). The second connector can include a second housing (e.g., the housing 352) and a respective second plurality of contacts (e.g., the second contacts 18). A dielectric film thus forms on the first and second self-passivating transition metal contacts in response to submersion in the fluid. At 404, the first and second connectors are attached to provide electrical connection between the each of the first contacts and a respective one of the second contacts to conduct a respective one of the AC signals between the respective electrically-connected first and second contact pair, and to form at least one fluid-filled channel (e.g., the channel(s) 20) between each electrically-connected first and second contact pair. Each of the fluid-filled channel(s) can form a resistive path between electrically-connected first and second contact pairs. At 406, the first and second connectors are fastened via a first fastener (e.g., the threaded portion 304) associated with the first connector and a second fastener (e.g., the threaded portion 354) associated with the second connection portion to form the signal connector system.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A signal connector system comprising:

a first connector comprising a first housing and a first plurality of contacts formed from a self-passivating transition metal, each of the first contacts being configured to conduct an alternating current (AC) signal; and a second connector comprising a second housing and a second plurality of contacts formed from the self-passivating transition metal, each of the second contacts being configured to electrically couple to a respective one of the first contacts to conduct the AC signal, the first and second housings being configured to be coupled to substantially enclose the signal connector and to create at least one fluid-filled channel between each of the electrically-connected first and second contact pairs in response to fastening the first and second connectors while submerged in a respective fluid to provide a resistive path in the at least one fluid-filled channel for providing signal isolation between each of the electrically-connected first and second contact pairs.

2. The system of claim 1, wherein the first connector further comprises a first plurality of pliable insulator supports that are coupled to a respective one of the first contacts, wherein the second connector further comprises a second plurality of pliable insulator supports that are each coupled to a respective one of the second plurality of contacts, each of the first and second pliable insulator supports is configured to provide contact pressure between the respective first contacts and the respective second contacts to establish electrical connection between the respective first and second contacts.

3. The system of claim 2, wherein the first pliable insulator supports and the second pliable insulator supports are coupled to the respective first contacts and the respective second contacts along a first longitudinal surface, wherein each of the first and second pliable insulator supports comprises a second longitudinal surface opposite the first surface, wherein the second longitudinal surface of each of the first pliable insulator supports and the second longitudinal surface each of the respective second pliable insulator supports defines at least a portion of a respective one of the at least one fluid-filled channel.

4. The system of claim 2, wherein each of the first and second pliable insulator supports has a predetermined elasticity sufficient to substantially mitigate galling between the first and second contacts.

5. The system of claim 1, wherein each of the first contacts comprises a tapered contact surface that is arranged to provide electrical connection with a complementary tapered contact surface of a respective one of the second contacts.

6. The system of claim 5, wherein each of one of the first and second contacts comprises a projection extending from the respective tapered contact surface to provide the electrical connection with the tapered surface of the respective other of the first and second contacts.

7. The system of claim 1, wherein the first and second contacts are arranged in a polar array about the respective first and second connectors, such that the at least one fluid-filled channel is disposed between each electrically-connected first and second contact pair about the polar array.

8. The system of claim 1, wherein the first housing comprises a male thread pattern and the second housing comprises a female thread pattern, such that each electrically-connected set of the first and second contacts can have an approximately equal contact pressure when the first and second connectors are coupled together to form the signal connector system.

9. The system of claim 1, wherein each of the at least one fluid-filled channel has a geometrical arrangement designed to provide a resistance of the respective resistive path of greater than or equal to approximately 100Ω when filled with the associated fluid.

10. A method for providing a plurality of alternating current (AC) signals along a respective plurality of conductors across a signal connector system, the method comprising:

submerging a first connector and a second connector in a fluid, the first connector comprising a first housing and a first plurality of contacts formed from a self-passivating transition metal, the second connector comprising a second housing and a respective second plurality of contacts formed from the self-passivating transition metal, such that a dielectric film forms on the first and second contacts in response to submersion in the fluid;

attaching the first and second connectors to provide electrical connection between the each of the first contacts and a respective one of the second contacts to conduct a respective one of the AC signals between the respective electrically-connected first and second contact pair, and to form at least one fluid-filled channel between each electrically-connected first and second contact pair, each of the at least one fluid-filled channel forming a resistive path between electrically-connected first and second contact pairs; and fastening the first and second connectors via a first fastener associated with the first connector and a second fastener associated with the second connection portion to form the signal connector system.

11. The method of claim 10, wherein the first connector further comprises a first plurality of pliable insulator supports that are coupled to a respective one of the first contacts, wherein the second connector further comprises a second plurality of pliable insulator supports that are each coupled to a respective one of the second plurality of contacts, each of the first and second pliable insulator supports having a predetermined elasticity configured to provide a predetermined contact pressure between the respective first contacts and the respective second contacts to establish the electrical connection between the respective first and second contacts.

12. The method of claim 11, wherein the first pliable insulator supports and the second pliable insulator supports are coupled to the respective first contacts and the respective second contacts along a first longitudinal surface, wherein each of the first and second pliable insulator supports comprises a second longitudinal surface opposite the first surface, wherein the second longitudinal surface of each of the first pliable insulator supports and the second longitudinal surface each of the respective second pliable insulator supports defines at least a portion of a respective one of the at least one fluid-filled channel.

13. The method of claim 10, wherein each of the first contacts comprises a tapered contact surface that is arranged to provide electrical connection with a complementary tapered contact surface of a respective one of the second contacts.

14. The method of claim 10, wherein the first fastener is arranged as a male thread pattern and wherein the second fastener is arranged as a female thread pattern, such that fastening the first and second connectors comprises fastening the male and female thread patterns to provide an approximately equal contact pressure for each of the electrically-connected first and second contact pairs.

15. The method of claim 10, wherein each of the at least one fluid-filled channel has a geometrical arrangement designed to provide a resistance of the respective resistive path of greater than or equal to approximately 100Ω when filled with the associated fluid.

16. A signal connector system comprising:

a first connector comprising:

a first plurality of contacts formed from a self-passivating transition metal, each of the first contacts being configured to conduct an alternating current (AC) signal;

a first plurality of pliable insulator supports that are coupled to a respective one of the first contacts; and a first housing configured to substantially enclose the first pluralities of contacts and pliable insulator supports and comprising a first fastener; and a second connector comprising:

a second plurality of contacts formed from the self-passivating transition metal;

a second plurality of pliable insulator supports that are coupled to a respective one of the second contacts; and a second housing configured to substantially enclose the second pluralities of contacts and pliable insulator supports and comprising a second fastener, the first and second housings being configured to be coupled via the respective first and second fasteners to create at least one fluid-filled channel between the first plurality of contacts and the second plurality of contacts whole submerged in a respective fluid and to substantially enclose the signal connector and to provide electrical connection between each of the first contacts and a respective one of the second contacts at a predetermined pressure to conduct the respective AC signal between each of the first contacts and the respective one of the second contacts.

17. The system of claim 16, wherein the first pliable insulator supports and the second pliable insulator supports are coupled to the respective first contacts and the respective second contacts along a first longitudinal surface, wherein each of the first and second pliable insulator supports comprises a second longitudinal surface opposite the first surface, wherein the second longitudinal surface of each of the first pliable insulator supports and the second longitudinal surface each of the respective second pliable insulator supports defines a respective one of the at least one fluid-filled channel.

18. The system of claim 16, wherein each of the first contacts comprises a tapered contact surface that is arranged to provide electrical connection with a complementary tapered contact surface of a respective one of the second contacts.

19. The system of claim 16, wherein the first and second contacts are arranged in a polar array about the respective first and second connectors, such that the at least one fluid-filled channel is disposed between each electrically-connected set of the first and second contacts around the polar array, and wherein the first connection portion comprises a male thread pattern and the second connection portion comprises a female thread portion, such that each of the electrically-connected first and second contact pairs can have an approximately equal contact pressure when the first and second connectors are coupled together to form the signal connector system.

20. The system of claim 16, wherein each of the at least one fluid-filled channel has a geometrical arrangement designed to provide a resistance of the respective resistive path of greater than or equal to approximately 100Ω when filled with the associated fluid.

* * * * *